US006341845B1

(12) United States Patent
Scheffelin et al.

(10) Patent No.: US 6,341,845 B1
(45) Date of Patent: Jan. 29, 2002

(54) ELECTRICAL CONNECTION FOR WIDE-ARRAY INKJET PRINTHEAD ASSEMBLY WITH HYBRID CARRIER FOR PRINTHEAD DIES

(75) Inventors: Joseph E. Scheffelin, Poway; Janis Horvath, San Diego; Brian J. Keefe, La Jolla, all of CA (US); Lawrence H. White, Corvallis, OR (US); Ali Emamjomeh, Duchess Crest (SG); Paul Mark Haines, Lebanon, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/648,120

(22) Filed: Aug. 25, 2000

(51) Int. Cl.[7] ..... B41J 2/155
(52) U.S. Cl. ..... 347/50; 347/42
(58) Field of Search ..... 347/40, 42, 50, 347/12, 13

(56) References Cited

U.S. PATENT DOCUMENTS 4,633,274 A * 12/1986 Matsuda ..... 347/50
5,016,023 A 5/1991 Chan et al. ..... 347/42
5,160,945 A 11/1992 Drake ..... 347/42
5,442,386 A 8/1995 Childers et al. ..... 347/50
5,696,544 A 12/1997 Komuru ..... 347/50
5,719,605 A 2/1998 Anderson et al. ..... 347/59
5,742,305 A 4/1998 Hackleman ..... 347/42
5,755,024 A 5/1998 Drake et al. ..... 29/611
5,946,012 A 8/1999 Courian et al. ..... 347/63
6,227,651 B1 * 5/2001 Watts et al. ..... 347/50

* cited by examiner

*Primary Examiner*—Anh T. N. Vo

(57) ABSTRACT

A wide-array inkjet printhead assembly includes a carrier and a printhead die. The carrier includes a substrate and an electrical circuit. The substrate has a first side and a second side such that the electrical circuit is disposed on the second side of the substrate. The printhead die is mounted on the first side of the substrate and electrically coupled to the electrical circuit. Thus, electrical connection is established between the first side of the substrate and second side of the substrate.

42 Claims, 7 Drawing Sheets

ELECTRICAL CONNECTION FOR WIDE-ARRAY INKJET PRINTHEAD ASSEMBLY WITH HYBRID CARRIER FOR PRINTHEAD DIES

CROSS-REFERENCE TO RELATED APPLICATIONS

This application is related to U.S. patent application Ser. No. 09/216,606, entitled "Multilayered Ceramic Substrate Serving as Ink Manifold and Electrical Interconnection Platform for Multiple Printhead Dies" filed on Dec. 17, 1998, assigned to the assignee of the present invention, and incorporated herein by reference. This application is related to U.S. patent application Ser. No. 09/648,564, entitled "Wide-Array Inkjet Printhead Assembly with Hybrid Carrier for Printhead Dies" filed on Aug. 25, 2000, assigned to the assignee of the present invention, and incorporated herein by reference.

THE FIELD OF THE INVENTION

The present invention relates generally to inkjet printheads, and more particularly to a wide-array inkjet printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single carrier, however, requires that the single carrier perform several functions including fluid and electrical routing as well as printhead die support. More specifically, the single carrier must accommodate communication of ink between the ink supply and each of the printhead dies, accommodate communication of electrical signals between the electronic controller and each of the printhead dies, and provide a stable support for each of the printhead dies. Unfortunately, effectively combining these functions in one unitary structure is difficult.

Accordingly, a need exists for a carrier which provides support for a plurality of printhead dies while accommodating fluidic and electrical routing to each of the printhead dies.

SUMMARY OF THE INVENTION

One aspect of the present invention provides an inkjet printhead assembly. The inkjet printhead assembly includes a carrier including a substrate having a first side and a second side, and an electrical circuit disposed on a second side of the substrate. As such, a printhead die is mounted on a first side of the substrate and at least one electrical connector is electrically coupled to the electrical circuit and the printhead die.

In one embodiment, the electrical circuit includes a printed circuit board, wherein the printed circuit board and the substrate both have at least one ink passage extending therethrough. As such, the at least one ink passage communicates with the first side of the substrate and the printhead die for supplying ink thereto.

In one embodiment, the electrical circuit includes a first interface to which the at least one electrical connector is electrically coupled. In one embodiment, the first interface includes at least one electrical contact and the printhead die includes at least one electrical contact. Thus, the at least one electrical connector is electrically coupled to both the electrical contact of the first interface and the electrical contact of the printhead die.

In one embodiment, the substrate has at least one opening defined therein. As such, the electrical contact of the first interface is accessible through the opening and the electrical connector passes through the opening.

In one embodiment, the electrical connector includes a wire lead having a first end electrically coupled to the electrical contact of the first interface and a second end electrically coupled to the electrical contact of the printhead die.

In one embodiment, the electrical connector further includes a lead frame having a first tab electrically coupled to the electrical contact of the first interface and a second tab electrically coupled to the first end of the wire lead.

In one embodiment, the electrical connector further includes a lead pin having a first end electrically coupled to the electrical contact of the first interface and a second end electrically coupled to the first end of the wire lead.

In one embodiment, the electrical circuit includes a second interface. Thus, at least one electrical interconnect is electrically coupled to the second interface. In one embodiment, the electrical connector communicates with the first side of the substrate and the second side of the substrate. In one embodiment, the second side of the substrate is opposed to the first side of the substrate.

Another aspect of the present invention provides a method of forming an inkjet printhead assembly. The method includes providing a substrate having a first side and a second side, disposing an electrical circuit on the second side of the substrate, mounting a printhead die on the first side of the substrate, and electrically coupling at least one electrical connector with the electrical circuit and the printhead die.

Another aspect of the present invention provides a carrier adapted to receive a printhead die. The carrier includes a substrate having a first side adapted to receive the printhead die, an electrical circuit disposed on a second side of the substrate, and at least one electrical connector electrically coupled to the electrical circuit, wherein the at least one electrical connector communicates with the first side of the substrate.

Another aspect of the present invention provides a method of forming a carrier for a printhead die. The method includes providing a substrate having a first side adapted to receive the printhead die, disposing an electrical circuit on a second side of the substrate, and electrically coupling at least one electrical connector with the electrical circuit and communicating the at least one electrical connector with the first side of the substrate.

The present invention provides a carrier which provides support for a printhead die while accommodating fluidic and electrical routing to the printhead die.

DESCRIPTION OF THE PREFERRED EMBODIMENT

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
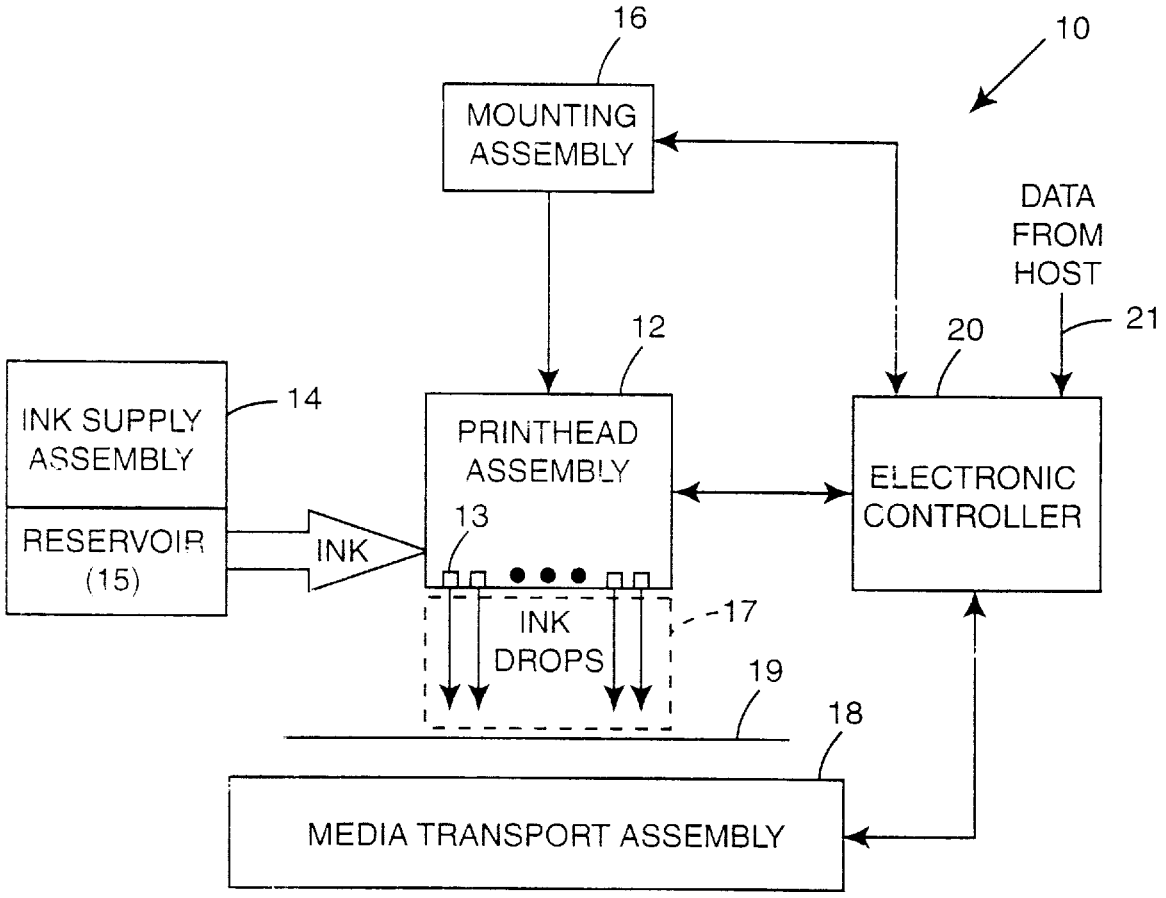
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system. substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is incorporated in an integrated circuit (IC) 22 located on inkjet printhead assembly 12 (shown in FIG. 5). In another embodiment, logic and drive circuitry is located off inkjet printhead assembly 12.

Figure 2:
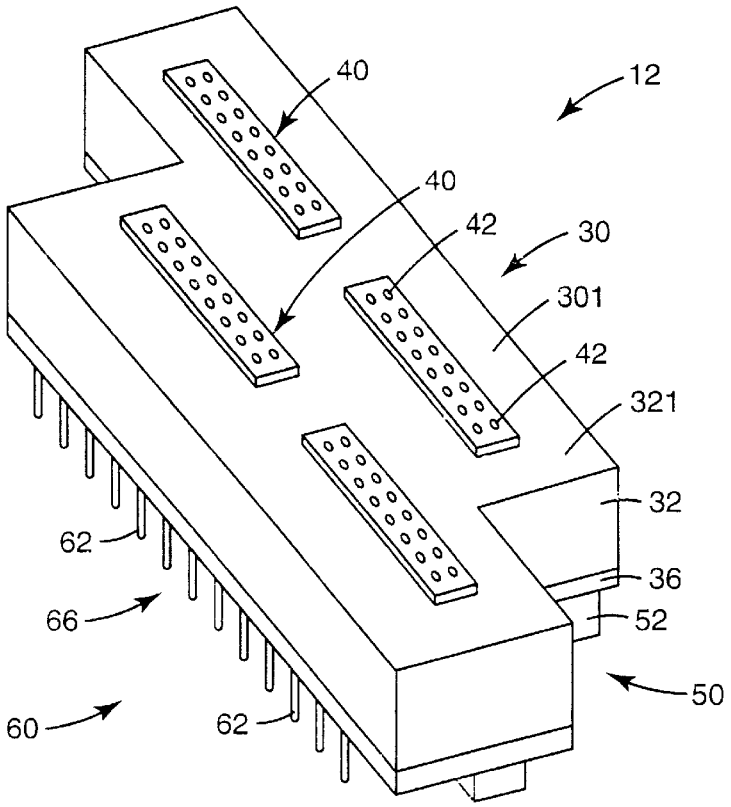
FIG. 2 is a top perspective view of an inkjet printhead assembly including a plurality of printhead dies according to the present invention.
Figure 3:
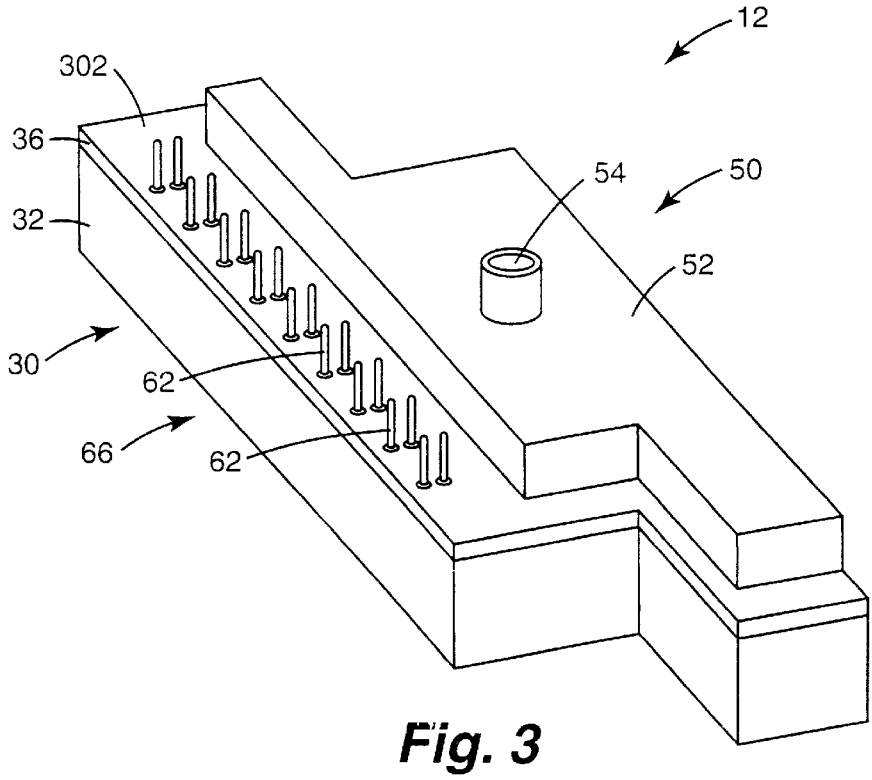
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposed to and oriented substantially parallel to first face 301. Carrier 30 serves to carry printhead dies 40 and provide electrical and fluidic communication between printhead dies 40, ink supply assembly 14, and electronic controller 20.

Printhead dies 40 are mounted on first face 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is mounted on second face 302 of carrier 30 and distributes ink through carrier 30 to each printhead die 40. Port 54 communicates with manifold 52 and provides an inlet for ink supplied by ink supply assembly 14.

Electronic interface system 60 electrically couples electronic controller 20 with printhead dies 40. In one embodiment, electronic interface system 60 includes a plurality of electrical or input/output (I/O) contacts 62. I/O contacts 62 are provided on second face 302 of carrier 30 and communicate electrical signals between electronic controller 20 and printhead dies 40 through carrier 30. Examples of I/O contacts 62 include I/O pins which engage corresponding I/O receptacles electrically coupled to electric controller 20 and I/O contact pads or fingers which contact corresponding electrical nodes electrically coupled to electronic controller 20.

Figure 4:
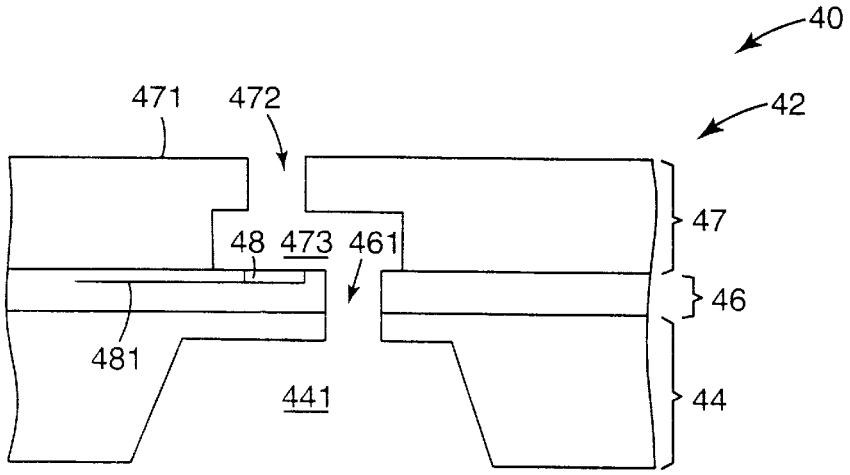
FIG. 4 is a schematic cross-sectional view illustrating portions of a printhead die according to the present invention.

As illustrated in FIGS. 2 and 4, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
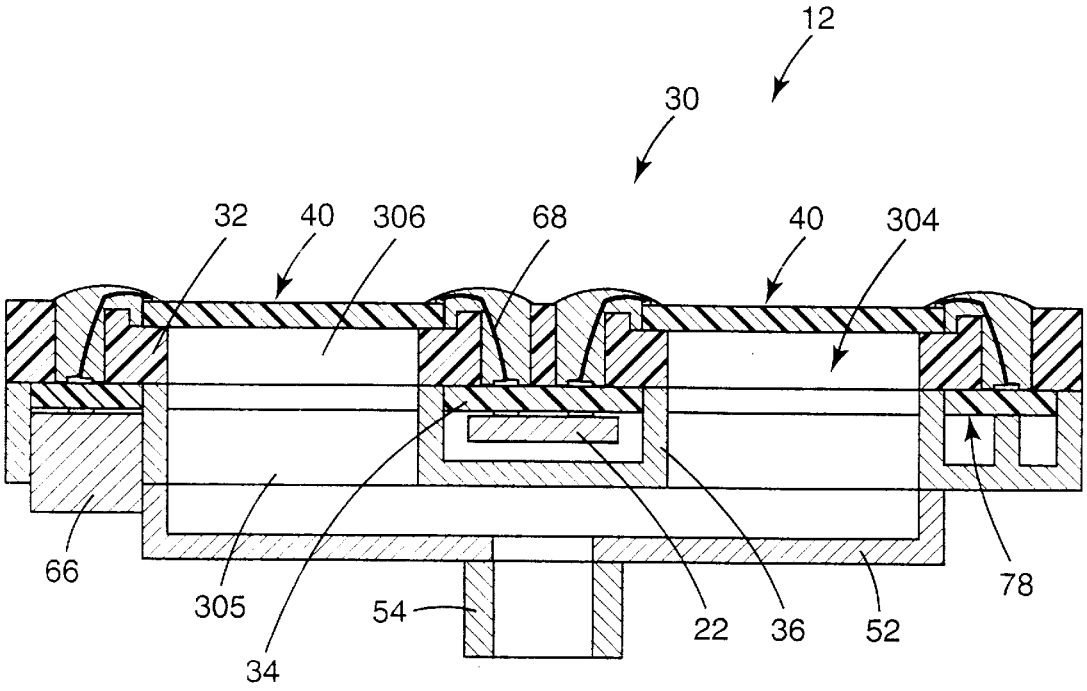
FIG. 5 is a schematic cross-sectional view of an inkjet printhead assembly illustrating one embodiment of an electrical connector according to the present invention.
Figure 6:
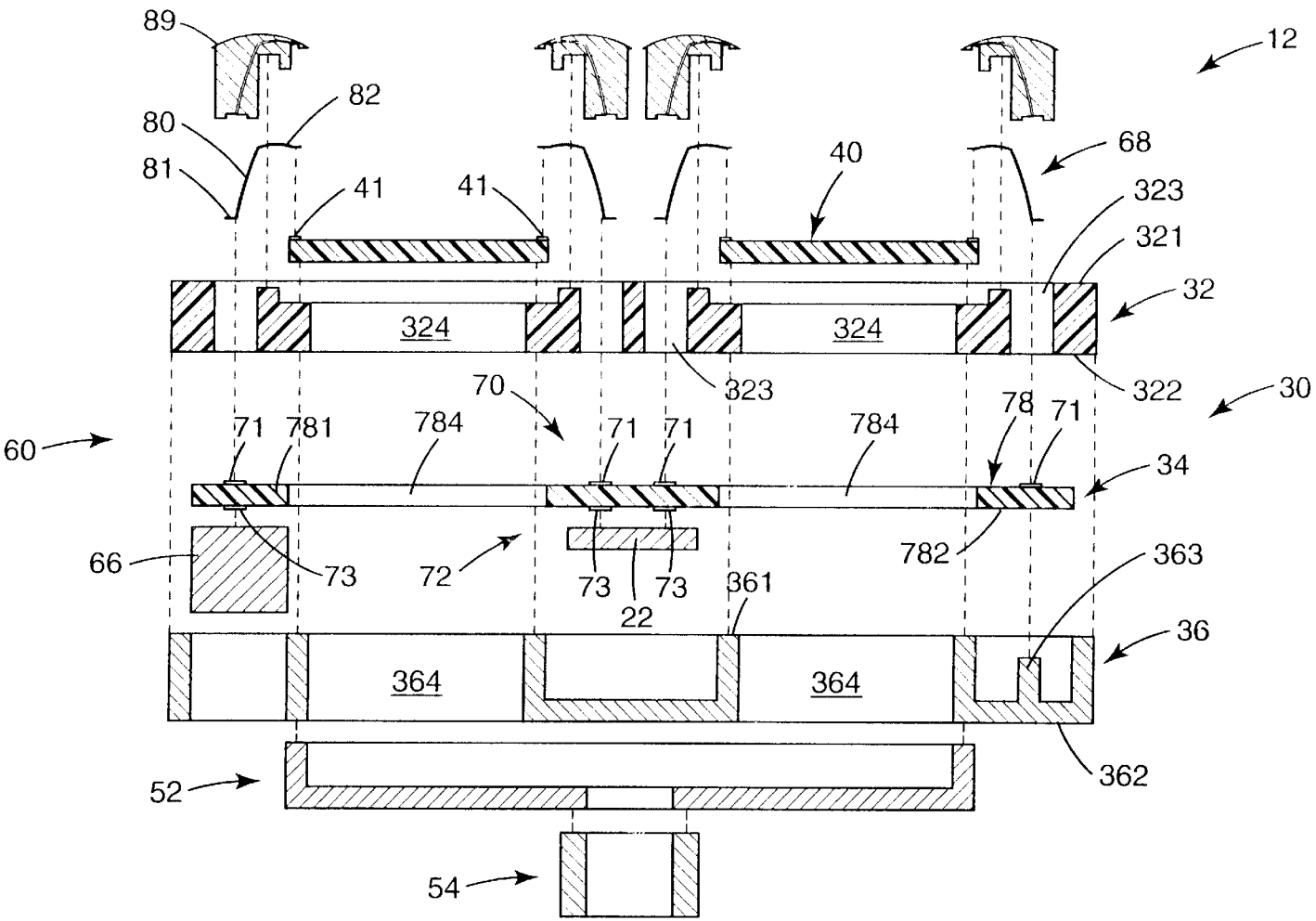
FIG. 6 is an exploded view of the inkjet printhead assembly of FIG. 5.
Figure 7:
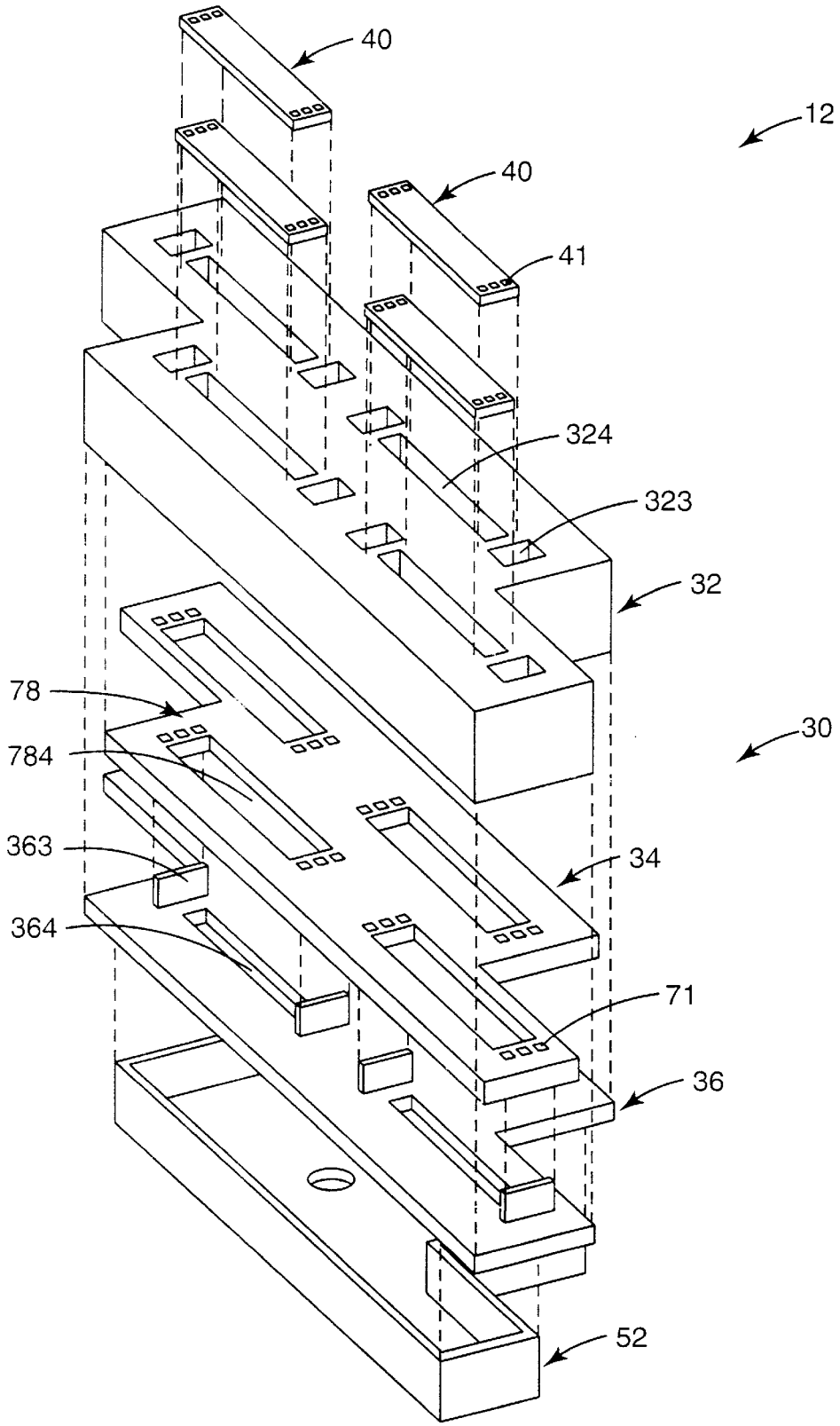
FIG. 7 is an exploded top perspective view of an inkjet printhead assembly according to the present invention.

Referring to FIGS. 5–7, carrier 30 includes a substrate 32 and an electrical circuit 34. Substrate 32 provides and accommodates mechanical, electrical, and fluidic functions of inkjet printhead assembly 12 while electrical circuit 34 provides and accommodates electrical and fluidic functions of inkjet printhead assembly 12. More specifically, substrate 32 supports printhead dies 40. In addition, substrate 32 and electrical circuit 34 accommodate electrical interconnection between and among printhead dies 40 and electronic controller 20 via electronic interface system 60. Furthermore, substrate 32 and electrical circuit 34 accommodate fluidic communication between ink supply assembly 14 and printhead dies 40 via ink delivery system 50.

Substrate 32 has a top side 321 and a bottom side 322 which is opposed to top side 321. In one embodiment, electrical circuit 34 is disposed on bottom side 322 of substrate 32 and printhead dies 40 are mounted on top side 321 of substrate 32. In addition, printhead dies 40 are electrically coupled to electrical circuit 34. In one embodiment, substrate 32 and electrical circuit 34 are positioned and configured to protect electrical circuit 34 from mechanical damage and/or ink contact. In addition, substrate 32 facilitates electrical coupling between electrical circuit 34 and printhead dies 40. Thus, substrate 32 provides support for printhead dies 40, provides fluid routing to printhead dies 40, and provides protection of electrical circuit 34 from mechanical damage and/or ink contact.

In one embodiment, substrate 32 is formed of plastic, ceramic, silicon, stainless steel, or other suitable material or combination of materials. Substrate 32 is formed, for example, of a high performance plastic such as fiber reinforced noryl. Preferably, substrate 32 has a high modulus or rigidity to provide proper support for printhead dies 40, has a low coefficient of thermal expansion (CTE) to avoid expansion and ensure accurate alignment between printhead dies 40, and is chemically compatible with liquid ink to provide fluid routing and protection.

Figure 8:
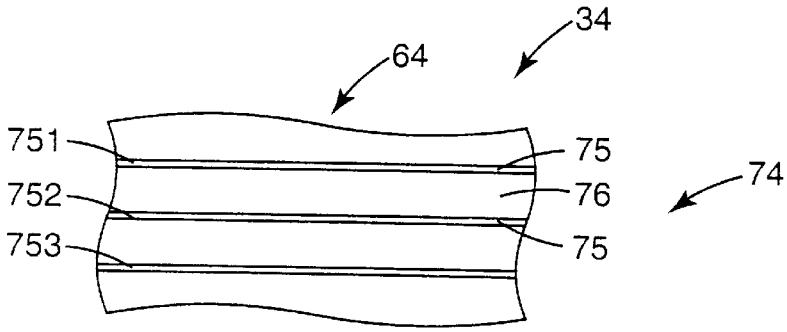
FIG. 8 is a schematic cross-sectional view of a portion of an electrical circuit of an inkjet printhead assembly according to the present invention.

For transferring electrical signals between electronic controller 20 and printhead dies 40, electrical circuit 34 establishes a plurality of conductive paths 64 (shown, for example, in FIG. 8). Conductive paths 64 define transfer paths for power, ground, and data among and between printhead dies 40 and electronic controller 20. In addition, electronic interface system 60 includes an electrical interconnect 66 and a plurality of electrical connectors 68.

Electrical interconnect 66 provides electrical coupling between electronic controller 20 and electrical circuit 34 while electrical connectors 68 provide electrical coupling between electrical circuit 34 and printhead dies 40. In one embodiment, electrical interconnect 66 is established, for example, by I/O contacts 62 electrically coupled to electrical circuit 34. Thus, electrical interconnect 66 facilitates electrical coupling between electronic controller 20 and inkjet printhead assembly 12.

In one embodiment, electrical circuit 34 includes a first interface 70 and a second interface 72. First interface 70 and second interface 71 both include a plurality of electrical contacts 71 and 73, respectively, which form bond pads for electrical circuit 34. Thus, electrical contacts 71 and 73 provide a point for electrical connection to electrical circuit 34 via, for example, I/O contacts 62, such as I/O pins, contact pads, spring fingers, and/or other suitable electrical connectors. Conductive paths 64 of electrical circuit 34 terminate at and provide electrical coupling between electrical contacts 71 of first interface 70 and electrical contacts 73 of second interface 72.

First interface 70 provides an input/output interface for communication with printhead dies 40 via electrical connectors 68 and second interface 72 provides an input/output interface for communication with electronic controller 20 via electrical interconnect 66. Electrical interconnect 66, therefore, is electrically coupled to at least one electrical contact 73 of second interface 72. In one embodiment, printhead dies 40 include electrical contacts 41 which form I/O bond pads. Thus, electrical connectors 68 electrically couple electrical contacts 71 of first interface 70 with electrical contacts 41 of printhead dies 40.

In one embodiment, substrate 32 has a plurality of openings 323 defined therein. Openings 323 are adjacent to opposite ends of printhead dies 40 and communicate with top side 321 and bottom side 322 of substrate 32. As such, openings 323 reveal or provide access to electrical contacts 71 of first interface 70. Electrical connectors 68, therefore, pass through associated openings 323 in substrate 32 when electrically coupling printhead dies 40 with electrical circuit 34. Thus, electrical connectors 68 provide electrical connection through substrate 32.

As electrical circuit 34 is disposed on bottom side 322 of substrate 32 and printhead dies 40 are mounted on top side 321 of substrate 32, electrical connectors 68 establish electrical connection between bottom side 322 of substrate 32 and top side 321 of substrate 32. Thus, electrical connectors 68 provide electrical connection between two discrete levels. More specifically, electrical connectors 68 establish electrical connection with electrical circuit 34 at a first level and electrical connection with printhead dies 40 at a second level which is above or offset from the first level. Electrical connectors 68, therefore, provide electrical connection between two separate or noncoplanar planes.

FIGS. 5 and 6 illustrate one embodiment of electrical connectors 68. Electrical connectors 68 include a wire bond or wire lead 80 having a first end 81 and a second end 82. To electrically couple printhead dies 40 with electrical circuit 34, wire lead 80 passes through an associated opening 323 in substrate 32. As such, first end 81 of wire lead 80 is electrically coupled to at least one electrical contact 71 of first interface 70 and second end 82 of wire lead 80 communicates with top side 321 of substrate 32. Thus, second end 82 of wire lead 80 is electrically coupled to at least one electrical contact 41 of printhead dies 40.

Electrical coupling between wire lead 80 and electrical contacts 41 and 71 is accomplished, for example, by wire bonding. In one embodiment, wire lead 80 constitutes a deep wire bond in that first end 81 is generally disposed on bottom side 322 of substrate 32 and second end 82 is generally disposed on top side 321 of substrate 32.

In one embodiment, encapsulation 89 surrounds wire lead 80. More specifically, encapsulation 89 seals bond areas of wire lead 80 and electrical contacts 41 and 71. Thus, an integrity of electrical connections between electrical contacts 71 of first interface 70, wire lead 80, and electrical contacts 41 of printheads 40 is maintained. Encapsulation 89, for example, protects against corrosion or electrical shorting caused by ink ingression at the electrical connections.

In one embodiment, electrical circuit 34 includes a printed circuit board 78. Printed circuit board 78 has a top side 781 and a bottom side 782 opposed to top side 781. Printed circuit board 78 is disposed on bottom side 322 of substrate 32 such that top side 781 of printed circuit board 78 is adjacent bottom side 322 of substrate 32. As such, first interface 70, including electrical contacts 71, is provided on top side 781 of printed circuit board 78 and second interface 72, including electrical contacts 73, is provided on bottom side 782 of printed circuit board 78. It is understood that printed circuit board 78 may be formed of multiple layers, as described below. In addition, it is within the scope of the present invention for electrical circuit 34 to include a flexible circuit such as a soft flex circuit or a rigid flex circuit. Thus, printed circuit board 78 may be formed as a rigid circuit or a flexible circuit.

In one embodiment, electronic controller 20 includes integrated circuit (IC) 22 which is mounted on printed circuit board 78. More specifically, IC 22 is mounted on bottom side 782 of printed circuit board 78. IC 22 is electrically coupled to printed circuit board 78 and, therefore, electrical circuit 34, via electrical contacts 73 of second interface 72. IC 22 includes logic and drive circuitry for inkjet printhead assembly 12 and, more specifically, printhead dies 40.

For transferring ink between ink supply assembly 14 and printhead dies 40, substrate 32 and printed circuit board 78 both have a plurality of ink passages 324 and 784, respectively, formed therein. Ink passages 324 extend through substrate 32 and ink passages 784 extend through printed circuit board 78. Ink passages 324 communicate with ink passages 784 so as to define a plurality of ink paths 304 through carrier 30 for delivery of ink to printhead dies 40 from manifold 52.

Ink paths 304 communicate at a first end 305 with manifold 52 of ink delivery system 50 and at a second end 306 with printhead dies 40. More specifically, second end 306 of ink paths 304 communicates with ink feed slot 441 of substrate 44. As such, ink paths 304 form a portion of ink delivery system 50. Although only one ink path 304 is shown for a given printhead die 40, there may be additional ink paths to the same printhead die to provide ink of respective differing colors.

In one embodiment, carrier 30 includes a cover 36. Cover 36 has a top side 361 and a bottom side 362 opposed to top side 361. Cover 36 is disposed on bottom side 322 of substrate 32 such that top side 361 of cover 36 is adjacent bottom side 322 of substrate 32. Thus, electrical circuit 34 is interposed between substrate 32 and cover 36. In addition, manifold 52 is disposed on bottom side 362 of cover 36.

In one embodiment, cover 36 includes a plurality of supports 363 which protrude upward from top side 361. Supports 363 contact electrical circuit 34 and support electrical circuit 34 relative to substrate 32. In one embodiment, supports 363 are positioned below and, therefore, provide support at electrical contacts 71 of first interface 70.

For transferring ink between ink supply assembly 14 and printhead dies 40, cover 36 has a plurality of ink passages 364 formed therein. Ink passages 364 extend through cover 36 such that ink passages 364 of cover 36 communicate with ink passages 784 and 324 of printed circuit board 78 and substrate 32, respectively. Ink passages 364 together with ink passages 784 and 324, therefore, further define ink paths 304 of carrier 30 for delivery of ink to printhead dies 40.

In one embodiment, substrate 32 together with cover 36 surround electrical circuit 34 so as to seal electrical circuit 34 from direct contact with ink passing through ink paths 304 of carrier 30. Printed circuit board 78, for example, fits within cover 36 as illustrated in FIG. 5 or fits within substrate 32 as illustrated in FIG. 7. More specifically, a portion of cover 36 or substrate 32 which defines ink passages 364 or 324, respectively, penetrates ink passages 784 of printed circuit board 78. Ink, therefore, flows through printed circuit board 78 but does not contact printed circuit board 78. Thus, ink from manifold 52 flows through cover 36, electrical circuit 34 including, more specifically, printed circuit board 78, and through substrate 32 to printhead dies 40.

In one embodiment, as illustrated in FIG. 8, electrical circuit 34 is formed of multiple planes or layers 74 including a plurality of conductive layers 75 and a plurality of non-conductive or insulative layers 76. Conductive layers 75 are formed, for example, by patterned traces of conductive material on insulative layers 76. As such, at least one insulative layer 76 is interposed between two conductive layers 75. Conductive layers 75 include, for example, a power layer 751, a data layer 752, and a ground layer 753. Power layer 751 conducts power for printhead dies 40, data layer 752 carries data for printhead dies 40, and ground layer 753 provides grounding for printhead dies 40.

Power layer 751, data layer 752, and ground layer 753 individually form portions of conductive paths 64 of electrical circuit 34. Thus, power layer 751, data layer 752, and ground layer 753 are each electrically coupled to first interface 70 and second interface 71 of electrical circuit 34 by, for example, conductive paths through insulative layers 76. As such, power, data, and ground are communicated between first interface 70 and second interface 71. The number of conductive layers 75 and insulative layers 76 can vary depending on the number of printhead dies 40 to be mounted on carrier 30 as well as the power and data rate requirements of printhead dies 40.

Figure 9A:
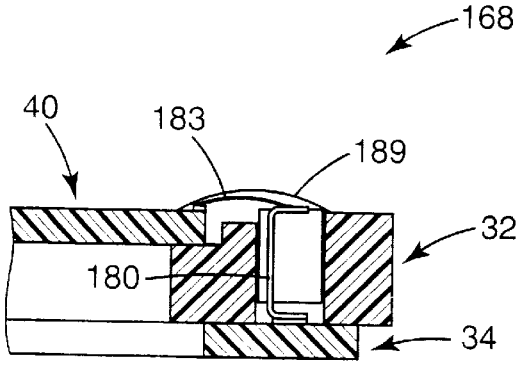
FIG. 9A is a schematic cross-sectional view of a portion of the inkjet printhead assembly of FIG. 5 illustrating another embodiment of an electrical connector according to the present invention.
Figure 9B:
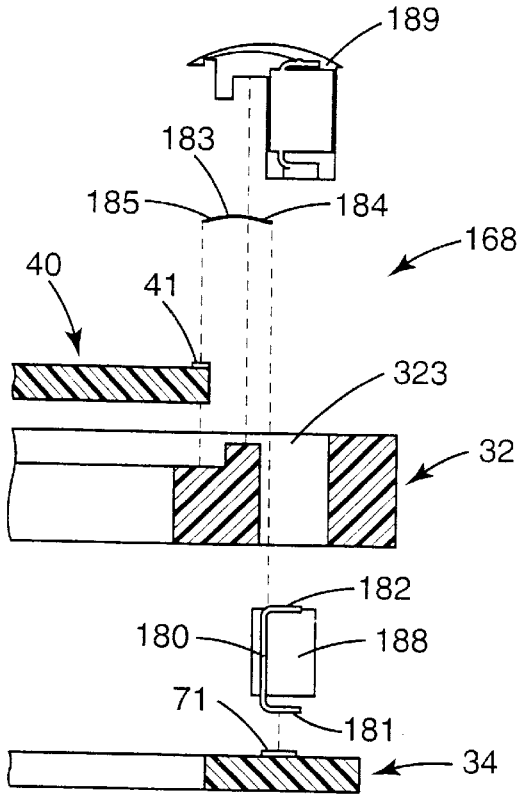
FIG. 9B is an exploded view of the inkjet printhead assembly of FIG. 9A.

FIGS. 9A and 9B illustrate another embodiment of electrical connectors 68. Electrical connectors 168 electrically couple electrical circuit 34 and printhead dies 40. Electrical connectors 168 include a lead frame 180 and a wire bond or wire lead 183. Lead frame 180 has a first tab 181 and a second tab 182, and wire lead 183 has a first end 184 and a second end 185.

To electrically couple printhead dies 40 with electrical circuit 34, lead frame 180 passes through an associated opening 323 in substrate 32. As such, first tab 181 of lead frame 180 is electrically coupled to at least one electrical contact 71 of first interface 70 and second tab 182 of lead frame 180 communicates with top side 321 of substrate 32. Thus, first end 184 of wire lead 183 is electrically coupled to second tab 182 of lead frame 180 and second end 185 of wire lead 183 is electrically coupled to at least one electrical contact 41 of printhead dies 40. Electrical coupling between lead frame 180 and electrical contact 71 is formed, for example, by a solder joint.

In one embodiment, lead frame 180 is embedded in a plug 188 which is sized to fit within opening 323 of substrate 32. First tab 181 of lead frame 180 and second tab 182 of lead fame 180 are provided at opposite ends of plug 188 and provide an area for electrical connection. In addition, lead frame 180 is sized and/or positioned within opening 323 such that second tab 182 of lead frame 180 communicates with top side 321 of substrate 32. Thus, second tab 182 of lead frame 180 provides a bonding site which is substantially planar with as well as adjacent to printhead dies 40. As such, bonding of wire lead 183 between lead frame 180 and printhead dies 40 is facilitated. Wire lead 183, therefore, constitutes a shallow wire bond in that wire lead 183, including first end 184 and second end 185, are both generally disposed on top side 321 of substrate 32.

In one embodiment, encapsulation 189 surrounds lead frame 180 and wire lead 183. More specifically, encapsulation 189 seals bond areas of lead frame 180, wire lead 183, and electrical contacts 41 and 71. Thus, an integrity of electrical connections between electrical contacts 71 of first interface 70, lead frame 180, wire lead 183, and electrical contacts 41 of printhead dies 40 is maintained. Encapsulation 189, for example, protects against corrosion or electrical shorting caused by ink ingression at the electrical connections.

Figure 10A:
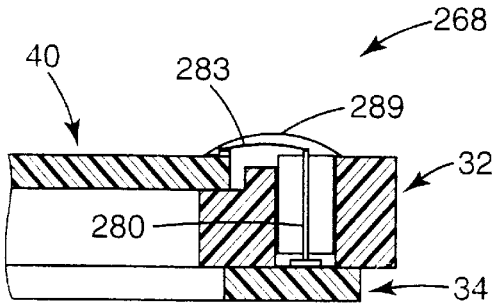
FIG. 10A is a schematic cross-sectional view of a portion of the inkjet printhead assembly of FIG. 5 illustrating another embodiment of an electrical connector according to the present invention.
Figure 10B:
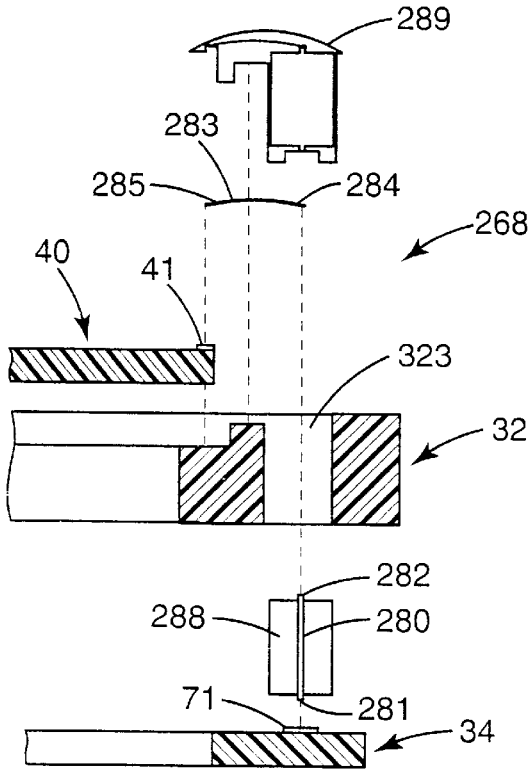
FIG. 10B is an exploded view of the inkjet printhead assembly of FIG. 10A.

FIGS. 10A and 10B illustrate another embodiment of electrical connectors 68. Electrical connectors 268 electrically couple electrical circuit 34 and printhead dies 40. Electrical connectors 268 include a lead pin 280 and a wire bond or wire lead 283. Lead pin 280 has a first end 281 and a second end 282, and wire lead 283 has a first end 284 and a second end 285.

To electrically couple printhead dies 40 with electrical circuit 34, lead pin 280 passes through an associated opening 323 in substrate 32. As such, first end 281 of lead pin 280 is electrically coupled to at least one electrical contact 71 of first interface 70 and second end 282 of lead pin 280 communicates with top side 321 of substrate 32. Thus, first end 284 of wire lead 283 is electrically coupled to second end 282 of lead pin 280 and second end 285 of wire lead 283 is electrically coupled to at least one electrical contact 41 of printhead dies 40. Electrical coupling between lead pin 280 and electrical contact 71 is formed, for example, by a solder joint.

In one embodiment, lead pin 280 is embedded in a plug 288 which is sized to fit within opening 323 of substrate 32. First end 281 of lead pin 280 and second end 282 of lead pin 280 are provided at opposite ends of plug 288 and provide a point for electrical connection. In addition, lead pin 280 is sized and/or positioned within opening 323 such that second end 282 of lead pin 280 communicates with top side 321 of substrate 32. Thus, second end 282 of lead pin 280 provides a bonding site which is substantially planar with as well as adjacent to printhead dies 40. As such, bonding of wire lead 283 between lead pin 280 and printhead dies 40 is facilitated. Wire lead 283, therefore, constitutes a shallow wire bond in that wire lead 283, including first end 284 and second end 285, are both generally disposed on top side 321 of substrate 32.

In one embodiment, encapsulation 289 surrounds lead pin 280 and wire lead 283. More specifically, encapsulation 289 seals bond areas of lead pin 280, wire lead 283, and electrical contacts 41 and 71. Thus, an integrity of electrical connections between electrical contacts 71 of first interface 70, lead pin 280, wire lead 283, and electrical contacts 41 of printheads 40 is maintained. Encapsulation 289, for example, protects against corrosion or electrical shorting caused by ink ingression at the electrical connections.

Figure 11A:
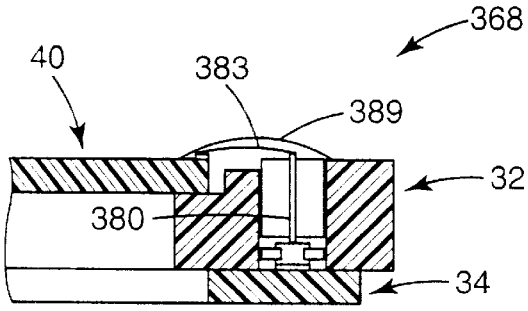
FIG. 11A is a schematic cross-sectional view of a portion of the inkjet printhead assembly of FIG. 5 illustrating another embodiment of an electrical connector according to the present invention.
Figure 11B:
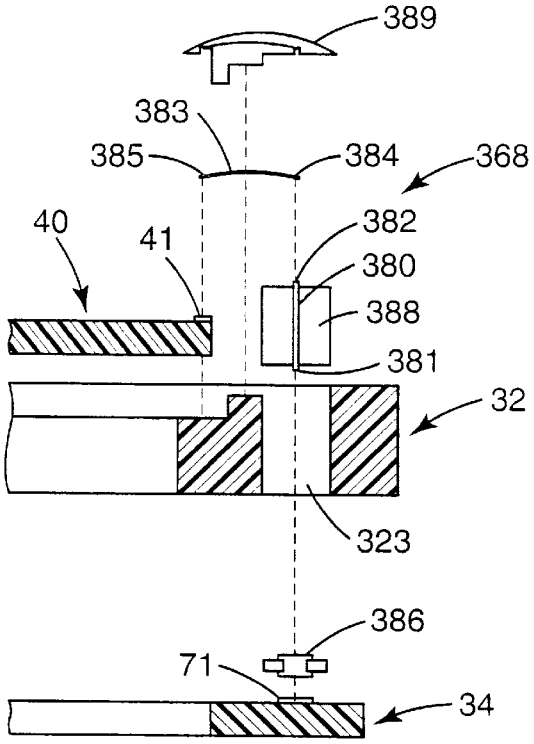
FIG. 11B is an exploded view of the inkjet printhead assembly of FIG. 11A.

FIGS. 11A and 11B illustrate another embodiment of electrical connectors 68. Electrical connectors 368 electrically couple electrical circuit 34 and printhead dies 40. Electrical connectors 368 include a lead pin 380, a wire bond or wire lead 383, and a pressure contact 386. Lead pin 380 has a first end 381 and a second end 382, and wire lead 383 has a first end 384 and a second end 385.

To electrically couple printhead dies 40 with electrical circuit 34, lead pin 380 passes through an associated opening 323 in substrate 32. As such, first end 381 of lead pin 380 is electrically coupled to at least one electrical contact 71 of first interface 70 via pressure contact 386 and second end 382 of lead pin 380 communicates with top side 321 of substrate 32. Thus, first end 384 of wire lead 383 is electrically coupled to second end 382 of lead pin 380 and second end 385 of wire lead 383 is electrically coupled to at least one electrical contact 41 of printhead dies 40.

In one embodiment, lead pin 380 is embedded in a plug 388 which is sized to fit within opening 323 of substrate 32. First end 381 of lead pin 380 and second end 382 of lead pin 380 are provided at opposite ends of plug 388 and provide a point for electrical connection. In addition, lead pin 380 is sized and/or positioned within opening 323 such that second end 382 of lead pin 380 communicates with top side 321 of substrate 32. Thus, second end 382 of lead pin 380 provides a bonding site which is substantially planar with as well as adjacent to printhead dies 40. As such, bonding of wire lead 383 between lead pin 380 and printhead dies 40 is facilitated. Wire lead 383, therefore, constitutes a shallow wire bond in that wire lead 383, including first end 384 and second end 385, are both generally disposed on top side 321 of substrate 32.

In one embodiment, encapsulation 389 surrounds wire lead 383. More specifically, encapsulation 389 seals bond areas of lead pin 380, wire lead 383, and electrical contacts 41. Thus, an integrity of electrical connections between lead pin 380, wire lead 383, and electrical contacts 41 of printheads 40 is maintained. Encapsulation 389, for example, protects against corrosion or electrical shorting caused by ink ingression at the electrical connections.

While lead frame 180, lead pin 280, and lead pin 380 are illustrated as being embedded within plugs 188, 288, and 388, respectively, which fit within openings 323 of substrate 32, it is within the scope of the present invention for lead frame 180, lead pin 280, and/or lead pin 380 to be formed in substrate 32. Lead frame 180, lead pin 280, and/or lead pin 380, for example, may be insert molded into substrate 32 or lead pin 280 and/or lead pin 380, for example, may be press fit into substrate 32.

By incorporating substrate 32 and electrical circuit 34 in carrier 30, carrier 30 accommodates communication of ink between ink supply assembly 14 and printhead dies 40, accommodates communication of electrical signals between electronic controller 20 and printhead dies 40, and provides a stable support for printhead dies 40. The functions of fluidic and electrical routing as well as printhead die support, therefore, are provided by a single carrier. In addition, by disposing electrical circuit 34 on bottom side 322 of substrate 32 and sealing electrical circuit 34 between substrate 32 and cover 36, direct ink contact with electrical circuit 34 is prevented. Thus, electrical shorts caused by ink ingression at electrical interfaces are avoided. In addition, by passing electrical connectors 68 through openings 323 in substrate 32 and between bottom side 322 and top side 321 of substrate 32, electrical conduits which are protected from direct ink contact are established for transferring power, ground, and data between electrical circuit 34 and printhead dies 40. Furthermore, by separating electrical circuit 34 from substrate 32, more design freedom for both substrate 32 and electrical circuit 34 is available. For example, more freedom in material choice and design of substrate 32 as well as electrical routing of electrical circuit 34 is available.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead assembly, comprising:

a carrier including a substrate and an electrical circuit, the substrate having a first side and a second side and at least one opening defined therein, the electrical circuit disposed on the second side of the substrate;

a printhead die mounted on the first side of the substrate; and at least one electrical connector electrically coupled to the electrical circuit and the printhead die, wherein the at least one electrical connector passes through the at least one opening of the substrate.

2. The inkjet printhead assembly of claim 1, wherein the electrical circuit includes a printed circuit board, and wherein the printed circuit board and the substrate both have at least one ink passage extending therethrough, the at least one ink passage communicating with the first side of the substrate and the printhead die.

3. The inkjet printhead assembly of claim 1, wherein the electrical circuit includes a first interface, the at least one electrical connector being electrically coupled to the first interface.

4. The inkjet printhead assembly of claim 3, wherein the first interface of the electrical circuit includes at least one electrical contact, wherein the printhead die includes at least one electrical contact, and wherein the at least one electrical connector is electrically coupled to the at least one electrical contact of the first interface and the at least one electrical contact of the printhead die.

5. The inkjet printhead assembly of claim 4, wherein the at least one electrical contact of the first interface is accessible through the at least one opening of the substrate.

6. The inkjet printhead assembly of claim 4, wherein the at least one electrical connector includes a wire lead having a first end electrically coupled to the at least one electrical contact of the first interface and a second end electrically coupled to the at least one electrical contact of the printhead die.

7. The inkjet printhead assembly of claim 6, wherein the at least one electrical connector further includes a lead frame having a first tab electrically coupled to the at least one electrical contact of the first interface and a second tab electrically coupled to the first end of the wire lead.

8. The inkjet printhead assembly of claim 6, wherein the at least one electrical connector further includes a lead pin having a first end electrically coupled to the at least one electrical contact of the first interface and a second end electrically coupled to the first end of the wire lead.

9. The inkjet printhead assembly of claim 3, wherein the electrical circuit includes a second interface, and further comprising:

at least one electrical interconnect electrically coupled to the second interface.

10. The inkjet printhead assembly of claim 1, wherein the at least one electrical connector communicates with the first side of the substrate and the second side of the substrate.

11. The inkjet printhead assembly of claim 1, wherein the second side of the substrate is opposed to the first side of the substrate.

12. A method of forming an inkjet printhead assembly, the method comprising the steps of:

providing a substrate having a first side and a second side and at least one opening defined therein;

disposing an electrical circuit on the second side of the substrate;

mounting a printhead die on the first side of the substrate; and electrically coupling at least one electrical connector with the electrical circuit and the printhead die, including passing the at least one electrical connector through the at least one opening of the substrate.

13. The method of claim 12, wherein the electrical circuit includes a printed circuit board, and wherein the printed circuit board and the substrate both have at least one ink passage extending therethrough, the at least one ink passage communicating with the first side of the substrate and the printhead die.

14. The method of claim 12, wherein the electrical circuit includes a first interface, and wherein the step of electrically coupling the at least one electrical connector includes electrically coupling the at least one electrical connector with the first interface of the electrical circuit.

15. The method of claim 14, wherein the first interface of the electrical circuit includes at least one electrical contact, wherein the printhead die includes at least one electrical contact, and wherein the step of electrically coupling the at least one electrical connector includes electrically coupling the at least one electrical connector with the at least one electrical contact of the first interface and the at least one electrical contact of the printhead die.

16. The method of claim 15, wherein the at least one electrical contact of the first interface is accessible through the at least one opening of the substrate.

17. The method of claim 14, wherein the at least one electrical connector includes a wire lead, and wherein the step of electrically coupling the at least one electrical connector includes electrically coupling a first end of the wire lead with the at least one electrical contact of the first interface and electrically coupling a second end of the wire lead with the at least one electrical contact of the printhead die.

18. The method of claim 17, wherein the at least one electrical connector further includes a lead frame, and wherein the step of electrically coupling the at least one electrical connector includes electrically coupling a first tab of the lead frame with the at least one electrical contact of the first interface and electrically coupling the first end of the wire lead with a second tab of the lead frame.

19. The method of claim 17, wherein the at least one electrical connector further includes a lead pin, and wherein the step of electrically coupling the at least one electrical connector includes electrically coupling a first end of the lead pin with the at least one electrical contact of the first interface and electrically coupling the first end of the wire lead with a second end of the lead pin.

20. The method of claim 14, wherein the electrical circuit includes a second interface, and further comprising the step of:

electrically coupling at least one electrical interconnect with the second interface.

21. The method of claim 12, wherein the step of electrically coupling the at least one electrical connector includes communicating the at least one electrical connector with the first side of the substrate and the second side of the substrate.

22. The method of claim 12, wherein the second side of the substrate is opposed to the first side of the substrate.

23. A carrier adapted to receive a printhead die, the carrier comprising:

a substrate having a first side adapted to receive the printhead die and a second side;

an electrical circuit disposed on the second side of the substrate; and at least one electrical connector electrically coupled to the electrical circuit, wherein the substrate has at least one opening defined therein between the first side and the second side, and wherein the at least one electrical connector extends into the at least one opening of the substrate.

24. The carrier of claim 23, wherein the electrical circuit includes a printed circuit board, and wherein the printed circuit board and the substrate both have at least one ink passage extending therethrough, the at least one ink passage communicating with the first side of the substrate.

25. The carrier of claim 23, wherein the electrical circuit includes a first interface having at least one electrical contact, the at least one electrical connector being electrically coupled to the at least one electrical contact of the first interface.

26. The carrier of claim 25, wherein the at least one electrical contact of the first interface is accessible through the at least one opening of the substrate, and wherein the at least one electrical connector passes through the at least one opening of the substrate.

27. The carrier of claim 25, wherein the electrical circuit includes a second interface, and further comprising:

at least one electrical interconnect electrically coupled to the second interface.

28. The carrier of claim 23, wherein the at least one electrical connector includes a wire lead having a first end electrically coupled to the electrical circuit and a second end communicating with the first side of the substrate.

29. The carrier of claim 23, wherein the at least one electrical connector includes a lead frame having a first tab electrically coupled to the electrical circuit and a second tab communicating with the first side of the substrate.

30. The carrier of claim 23, wherein the at least one electrical connector includes a lead pin having a first end electrically coupled to the electrical circuit and a second end communicating with the first side of the substrate.

31. The carrier of claim 23, wherein the at least one electrical connector communicates with the first side of the substrate and the second side of the substrate.

32. The carrier of claim 23, wherein the second side of the substrate is opposed to the first side of the substrate.

33. A method of forming a carrier for a printhead die, the method comprising the steps of:

providing a substrate having a first side adapted to receive the printhead die and a second side, and having at least one opening defined therein between the first side and the second side;

disposing an electrical circuit on the second side of the substrate; and electrically coupling at least one electrical connector with the electrical circuit and extending the at least one electrical connector into the at least one opening of the substrate.

34. The method of claim 33, wherein the electrical circuit includes a printed circuit board, and wherein the printed circuit board and the substrate both have at least one ink passage extending therethrough, the at least one ink passage communicating with the first side of the substrate.

35. The method of claim 33, wherein the electrical circuit includes a first interface having at least one electrical contact, and wherein the step of electrically coupling the at least one electrical connector includes electrically coupling the at least one electrical connector with the at least one electrical contact of the first interface.

36. The method of claim 35, wherein the at least one electrical contact of the first interface is accessible through the at least one opening of the substrate, and wherein the step of electrically coupling the at least one electrical connector includes passing the at least one electrical connector through the at least one opening of the substrate.

37. The method of claim 35, wherein the electrical circuit includes a second interface, and further comprising the step of:

electrically coupling at least one electrical interconnect with the second interface.

38. The method of claim 33, wherein the at least one electrical connector includes a wire lead, and wherein the step of electrically coupling the at least one electrical connector includes electrically coupling a first end of the wire lead with the electrical circuit and communicating a second end of the wire lead with the first side of the substrate.

39. The method of claim 33, wherein the at least one electrical connector includes a lead frame, and wherein the step of electrically coupling the at least one electrical connector includes electrically coupling a first tab of the lead frame with the electrical circuit and communicating a second tab of the lead frame with the first side of the substrate.

40. The method of claim 33, wherein the at least one electrical connector includes a lead pin, and wherein the step of electrically coupling the at least one electrical connector includes electrically coupling a first end of the lead pin with the electrical circuit and communicating a second end of the lead pin with the first side of the substrate.

41. The method of claim 33, wherein the step of electrically coupling the at least one electrical connector includes communicating the at least one electrical connector with the first side of the substrate and the second side of the substrate.

42. The method of claim 33, wherein the second side of the substrate is opposed to the first side of the substrate.

* * * * *